US007374380B2

(12) United States Patent
Huang

(10) Patent No.: US 7,374,380 B2
(45) Date of Patent: May 20, 2008

(54) TELESCOPIC COLUMN

(76) Inventor: Han-Ching Huang, No. 12, Alley 111, Lane 437, Chen Hsing Road, Taichung (TW)

( * ) Notice: Subject to any disclaimer, the term of this patent is extended or adjusted under 35 U.S.C. 154(b) by 328 days.

(21) Appl. No.: 11/306,471

(22) Filed: Dec. 29, 2005

(65) Prior Publication Data

US 2007/0151195 A1 Jul. 5, 2007

(51) Int. Cl.
*B60P 7/08* (2006.01)

(52) U.S. Cl. ..... 410/151; 410/143

(58) Field of Classification Search ..... 410/143, 410/151, 145; 211/105.5; 248/354.6, 354.7; 74/141.5, 167, 169; 254/12, 95, 108, 112
See application file for complete search history.

(56) References Cited

U.S. PATENT DOCUMENTS 6,755,600 B2 * 6/2004 Scott ..... 410/151

OTHER PUBLICATIONS

Taiwanese Patent Publication No. M274466, Sep. 1, 1994, 12 pages.

* cited by examiner

*Primary Examiner*—Stephen Gordon
(74) *Attorney, Agent, or Firm*—Alan Kamrath; Kamrath & Associates PA

(57) ABSTRACT

A telescopic column includes a cylinder and a post inserted in the cylinder partially. The post includes a ladder formed thereon. A mount is attached to the cylinder. A positioning element is installed on the mount pivotally. The positioning element includes a dent for engagement with the ladder during an attempt to insert the post into the cylinder and for disengagement from the ladder when the post is extended from the cylinder. A gear is installed on the amount rotationally. A handle is installed on the mount so as to provide pivotal in an active direction and in an idle direction opposite to the active direction. An extending element is installed on the handle movably. The extending element includes a detent for engagement with the gear in the active direction of the pivotal of the handle and for disengagement from the gear in the idle direction of the pivotal of the handle.

20 Claims, 8 Drawing Sheets

TELESCOPIC COLUMN

BACKGROUND OF INVENTION

1. Field of Invention

The present invention relates to a telescopic column.

2. Related Prior Art

Disclosed in Taiwanese Patent M274466 is a telescopic column with a post 1 inserted in a cylinder 2 partially. A mount 4 is secured to the cylinder 2. Two plates 42 are formed on the mount 4. A handle 45 is installed on the plates 42 pivotally. An extending element 44 is installed on the handle 45 movably. A positioning element 46 is installed on the plates 42 pivotally. The post 1 defines a plurality of recesses 11. The extending element 44 includes a plurality of detents 441 for insertion in the recesses 11. As the handle 45 is pivoted in an active direction, the detents 441 are inserted in some of the recesses 11 so that the post 1 is lifted. As the handle 45 is pivoted in an idle direction opposite to the active direction, the detents 441 are moved from the recesses 11 so that the post 1 is not lifted. The positioning element 46 includes a detent 461 for insertion in one of the recesses 11 so as to prevent the post 1 from falling when the handle 45 is not pivoted in the active direction. However, when the telescopic column is used under a heavy load, the detents 441 tend to leave the recesses 11 so that the extending element 44 fails to lift the post 1. Moreover, the detent 461 is in perpendicular to the remaining portion of the positioning element 46 , and tends to deform under a heavy load from the post 1.

The present invention is intended to obviate or at least alleviate the problems encountered in prior art.

SUMMARY OF INVENTION

According to the present invention, a telescopic column includes a cylinder and a post inserted in the cylinder partially. The post includes a ladder formed thereon. A mount is attached to the cylinder. A positioning element is installed on the mount pivotally. The positioning element includes a dent for engagement with the ladder during an attempt to insert the post into the cylinder and for disengagement from the ladder when the post is extended from the cylinder. A gear is installed on the amount rotationally. A handle is installed on the mount so as to provide pivotal in an active direction and in an idle direction opposite to the active direction. An extending element is installed on the handle movably. The extending element includes a detent for engagement with the gear in the active direction of the pivotal of the handle and for disengagement from the gear in the idle direction of the pivotal of the handle.

The primary advantage of the telescopic column of the present invention is that the engagement of the extending element with the gear is reliable since the detent does not rattle on the teeth during an attempt to extend the post from the cylinder.

Other advantages and features of the present invention will become apparent from the following description referring to the drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
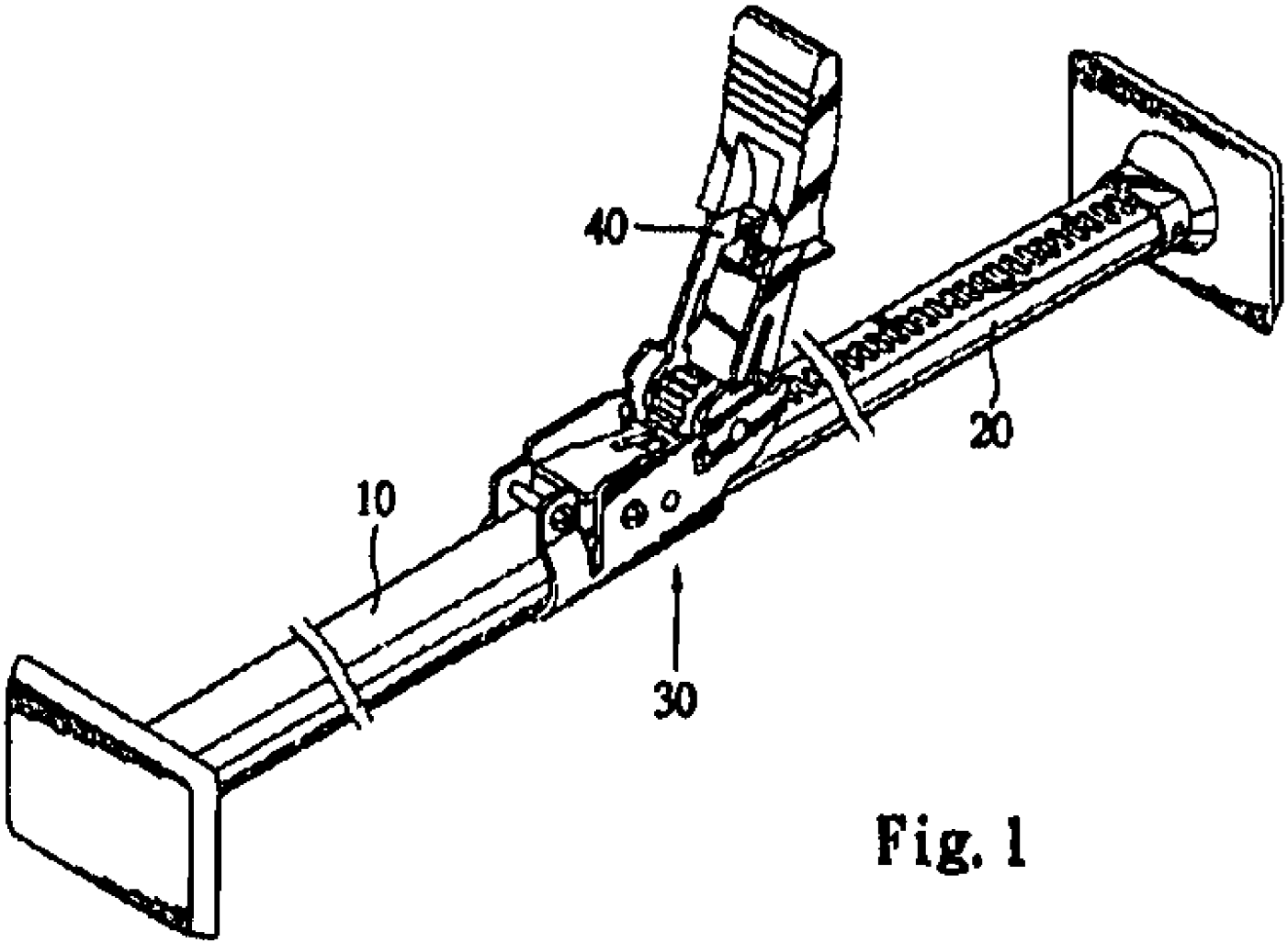
FIG. 1 is a perspective view of a telescopic column according to the preferred embodiment of the present invention.

Referring to FIG. 1, there is shown a telescopic column according to the preferred embodiment of the present invention. The telescopic column includes a cylinder 10, a post 20, a mount 30 and a handle 40.

Figure 2:
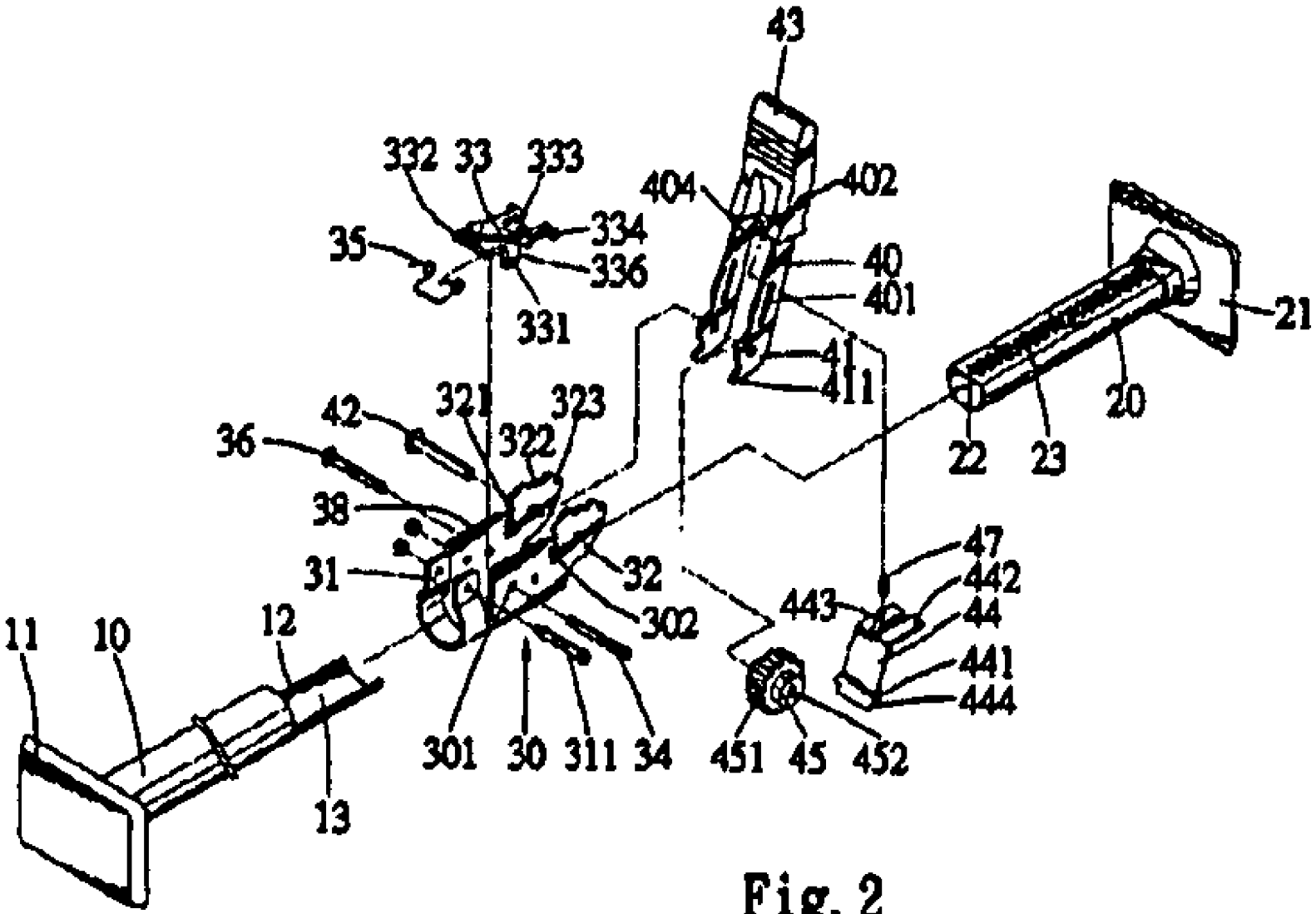
FIG. 2 is an exploded view of the telescopic column shown in FIG. 1.
Figure 3:
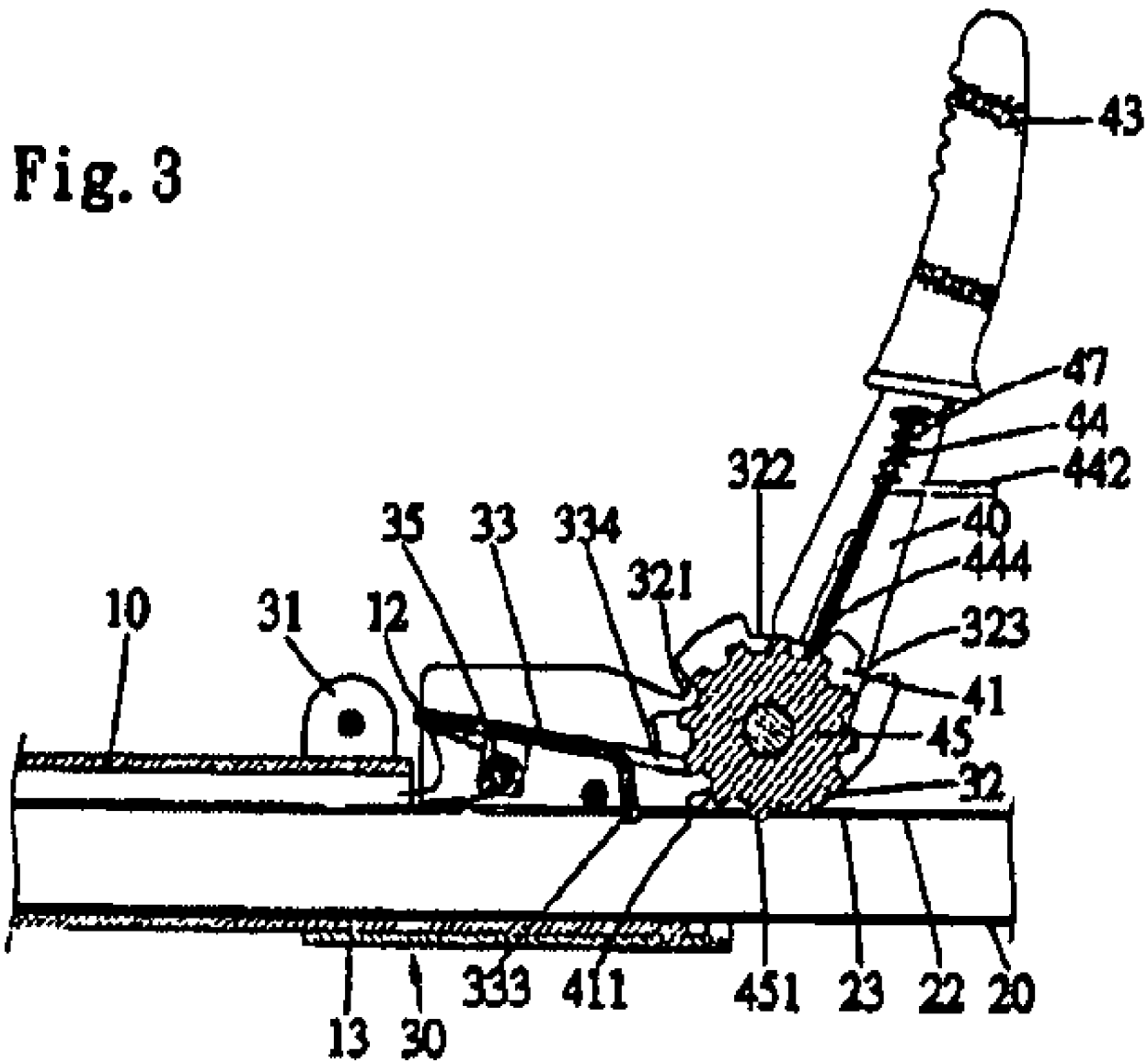
FIG. 3 is a cross-sectional partial view of the telescopic column shown in FIG. 1.

Referring to FIGS. 2 and 3, the cylinder 10 includes a first end and a second end. A plate 11 is secured to the first end of the cylinder 10. An opening 12 is defined in the second end of the cylinder 10. A semi-cylindrical extension 13 is extended from the second end of the cylinder 10.

The post 20 includes a first end and a second end. The first end of the post 20 is inserted in the cylinder 10 through the opening 12. A plate 21 is secured to the second end of the post 20. The post 20 includes a ladder 22 formed thereon by means of making a plurality of slots 23 therein.

The mount 30 looks like a "U" in an axial direction. The mount 30 includes two jaws 31 formed at an end, two ears 32 formed at an opposite end and two flank portions 38 between the jaws 31 and the ears 32. Each of the ears 32 defines a first cutout 321, a second cutout 322 and a third cutout 323. The second cutout 322 is located between the first cutout 321 and the third cutout 323. The second cutout 322 is longer and deeper than the first cutout 321 and the third cutout 323. Each of the flank portions 38 of the mount 30 defines an aperture 301 and a slot 302.

The jaws 31 of the mount 30 are positioned around the second end of the cylinder 10. A fastener 311 is driven in the jaws 31 of the mount 30 so that the jaws 31 hold on tight to the second end of the cylinder 10. Preferably, the fastener 311 includes a threaded bolt and a nut. A fastener 36 such as a rivet is driven in the flank portions 38 of the mount 30 for reinforcement.

A positioning element 33 is shaped like a seesaw. The positioning element 33 includes two pivotal portions 336, a detent 333, two prickles 334 and a shank 332. The pivotal portions 336 extend in perpendicular to the other portions of the positioning element 33 except the detent 333. The detent 333 is formed at an end of the positioning element 33 while the shank 332 is formed at an opposite end of the positioning element 33. Each of the pivotal portions 336 defines an aperture 331.

A torque spring 35 includes two looped portions.

The looped portions of the torque spring 35 are located between the pivotal portions 336 of the positioning element 33. The pivotal portions 336 of the positioning element 33 are located between the flank portions 38 of the mount 30. A fastener 34 is driven in the apertures 311 of the mount 30, the apertures 331 of the positioning element 33 and the looped portions of the torque spring 35. Preferably, the fastener 34 includes a threaded bolt and a nut. Thus, the positioning element 33 and the torque spring 35 are installed on the mount 30. The torque spring 35 is located between the shank 332 and the post 20 so that the detent 333 is forced into any proper one of the slots 23. The prickles 334 are positioned in the slots 302 so that the pivotal of the positioning element 33 is limited.

The handle 40 includes two lateral members 41 and a stop 404 formed between the lateral members 41. Each of the lateral members 41 of the handle 40 includes a first end, a second end and a slot 401 defined therein. The first end of each of the lateral members 41 of the handle 40 is formed with a crow tip 411. The second ends of the lateral members 41 of the handle 40 are inserted in a soft grip 43. The stop 404 defines an aperture 402.

A gear 45 includes a plurality of teeth 451 on the periphery and an aperture 452 defined therein centrally.

A fastener 34 is driven in the ears 32, the lateral members 41 and the aperture 452 so that the handle 40 and the gear 45 are installed on the mount 30.

An extending element 44 includes two fins 441 on two edges, a detent 444 at a first end, a rod 443 at a second end opposite to the first end and a tab 442 at the second end. The detent 444 is shaped like a ratchet as clearly shown in FIG. 3. The tab 442 is in perpendicular to the remaining portions of the extending element 44.

A spring 47 is provided on the rod 443. The rod 443 is inserted in the aperture 402. The spring 47 is compressed between the extending element 44 and the stop 404. Thus, the detent 444 is forced into engagement with the teeth 451. The fins 441 are positioned movably in the slots 401 so that the extending element 44 is smoothly movable on the handle 40.

Figure 4:
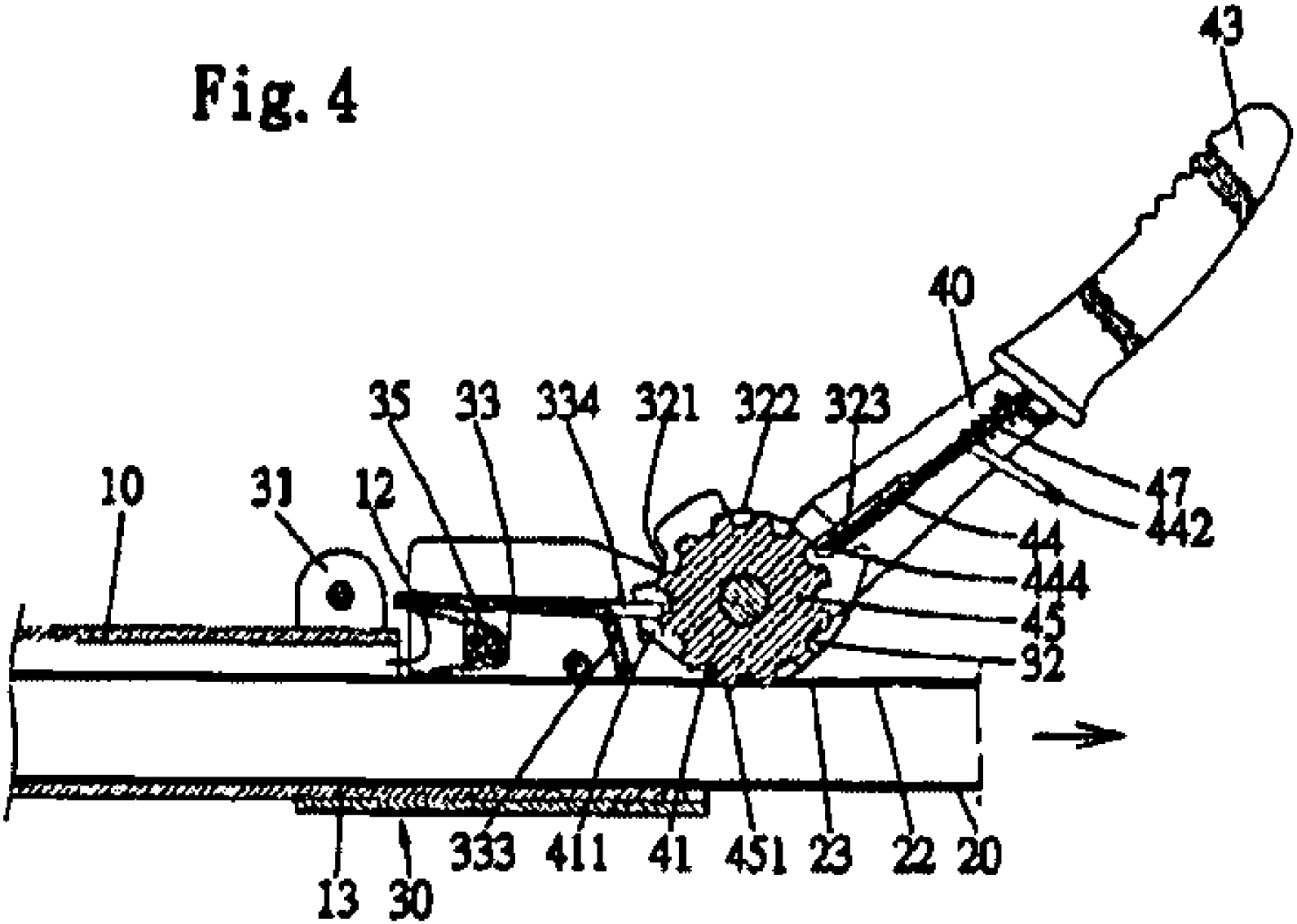
FIG. 4 is a cross-sectional partial view of the telescopic column in another position than shown in FIG. 3.

Referring to FIG. 4, the fins 441 are positioned in the cutouts 323 so that the detent 444 is disengaged from the teeth 451. The gear 45 is free to rotate. The prickles 334 are lifted by means of the crow tips 411 so that the detent 333 is moved from the ladder 22. Accordingly, the extending of the post 20 from the cylinder 10 is allowed.

The detent 333 is oriented so that it allows the extension of the post 20 from the cylinder 10 and that it prevents the retraction of the post 20 into the cylinder 10.

Figure 5:
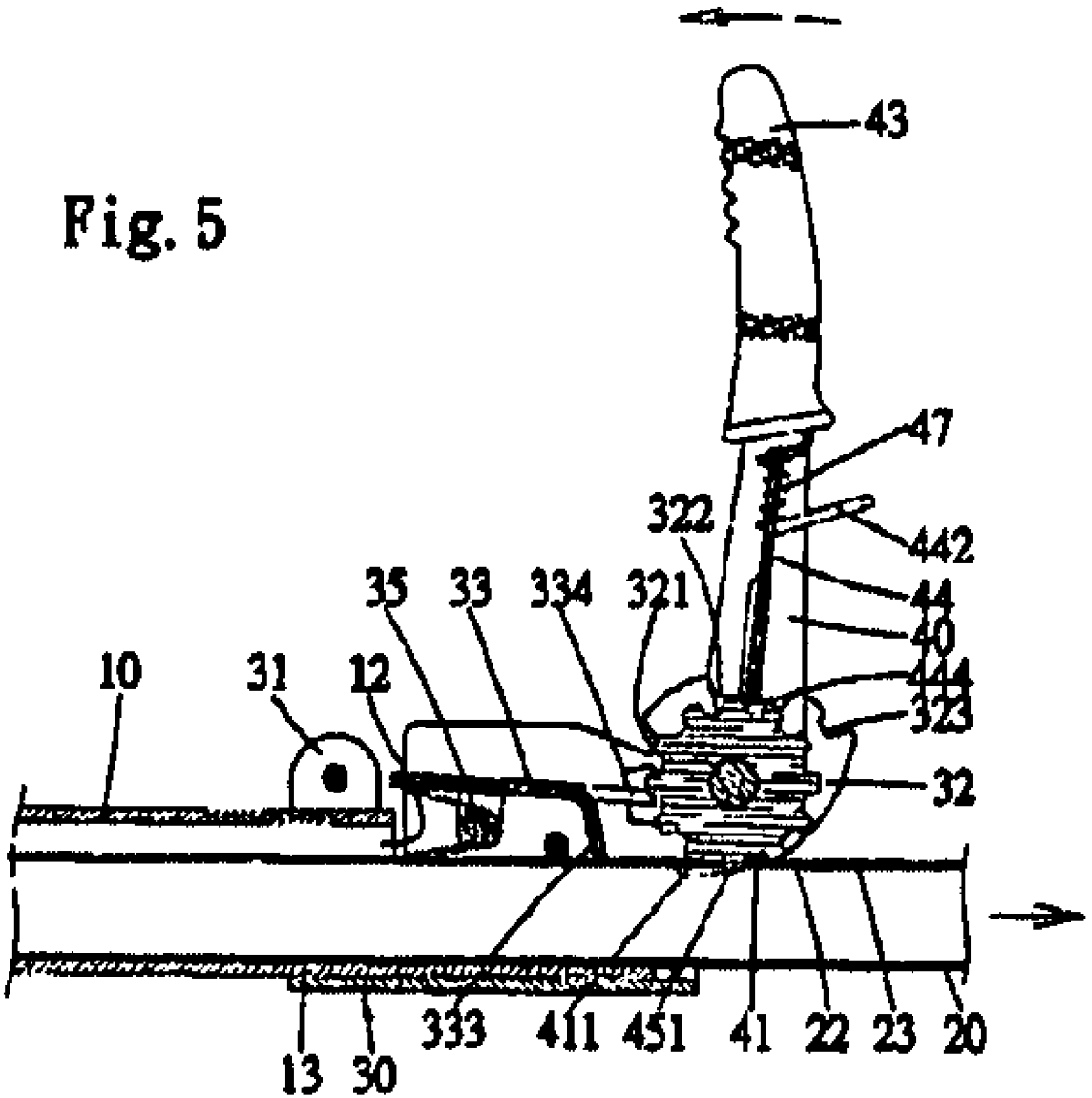
FIG. 5 is a cross-sectional partial view of the telescopic column in another position than shown in FIG. 4.
Figure 6:
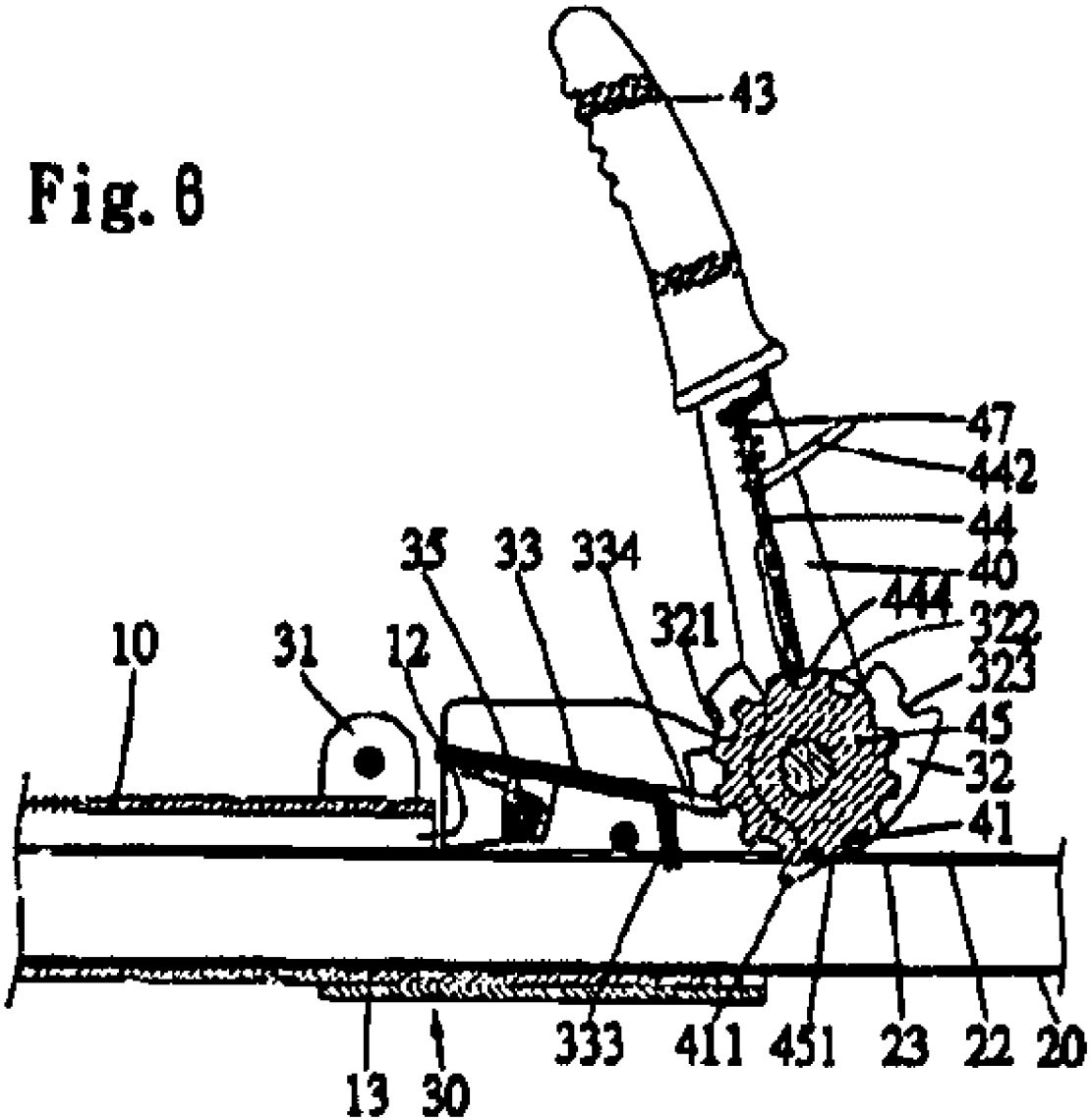
FIG. 6 is a cross-sectional partial view of the telescopic column in another position than shown in FIG. 5.

Referring to FIG. 5, after the post 20 is extended from the cylinder 10 almost to a desired extent such as when the plates 111 and 21 just contact external objects, the fins 441 are moved into the cutouts 322 from the cutouts 323 so that the detent 444 is engaged with the teeth 451. The handle 40 can be pivoted in an active direction so as to rotate the gear 45. The gear 45 extends the post 20 from the cylinder 10 as the gear 45 is in constant engagement with the ladder 22. When the fins 441 finish their travel in the cutouts 322, the handle 40 is stopped.

Figure 7:
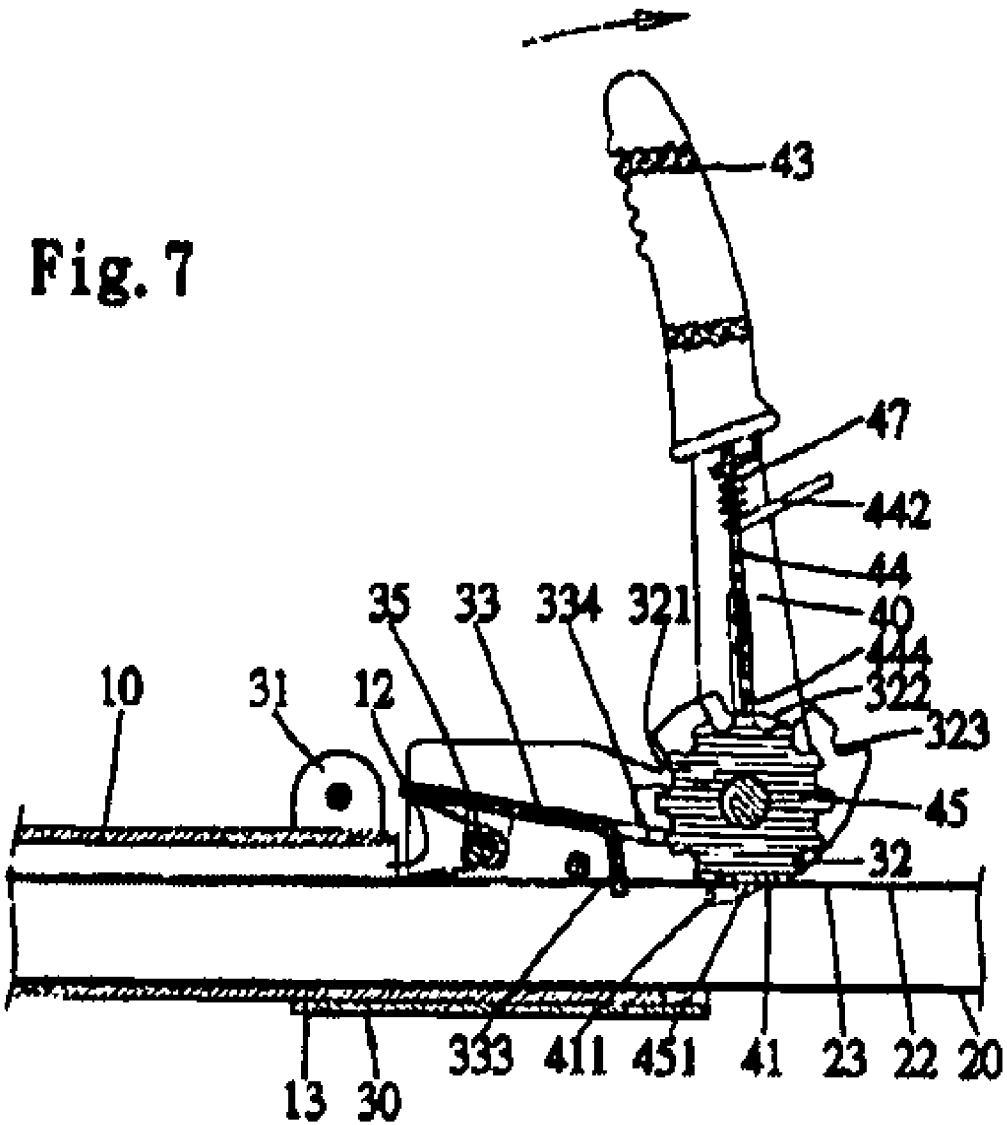
FIG. 7 is a cross-sectional partial view of the telescopic column in another position than shown in FIG. 6.

Referring to FIG. 7, the handle 40 is pivoted in an idle direction opposite to the active direction, the detent 444 rattles on the teeth 451 so that the extending element 44 does not rotate the gear 45. Accordingly, the gear 45 does not extend the post 20 from the cylinder 10.

Figure 8:
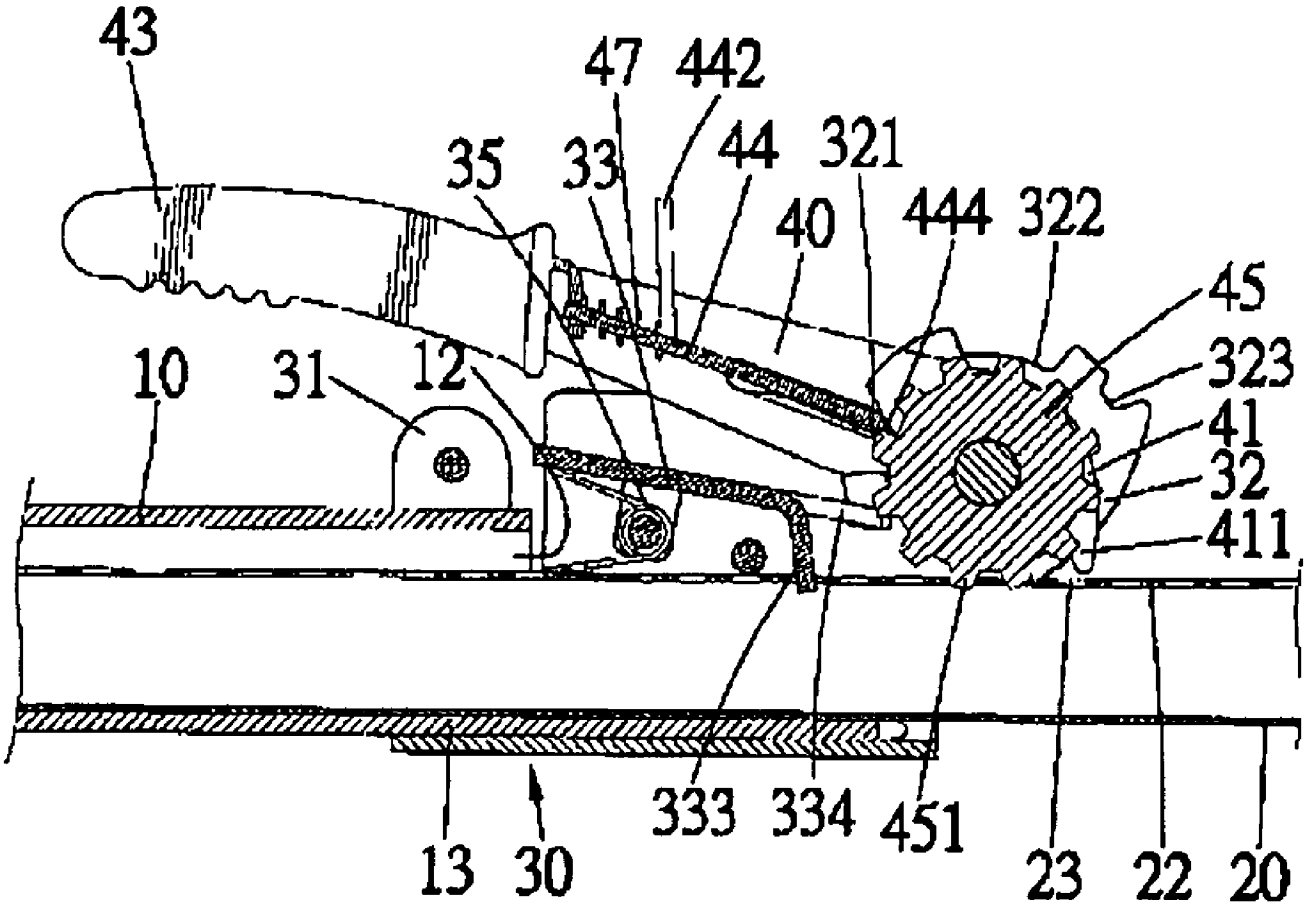
FIG. 8 is a cross-sectional partial view of the telescopic column in another position than shown in FIG. 7.

Referring to FIG. 8, as the post 20 is extended from the cylinder 10 to the desired extent, the fins 441 are moved into the cutouts 321 from the cutouts 322 so that the detent 444 is disengaged from the teeth 451 again. Now, the pivotal of the handle 40 does not cause the extension of the post 20 from the cylinder 20.

The telescopic column of the present invention exhibits several advantages. Firstly, the engagement of the extending element 44 with the gear 45 is reliable since the detent 444 does not rattle on the teeth 451 during an attempt to extend the post 20 from the cylinder 10. Secondly, the positioning element 33 is reliable and durable because the detent 333 is biased in the direction to the second end from the first end of the cylinder 10. Thirdly, the soft grip 43 provides a comfortable feel to users. Fourthly, the mount 30 is strong for the use of the rivet 46 and the semi-cylindrical extension 13.

The present invention has been described through the illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A telescopic column comprising:

a cylinder;

a post inserted in the cylinder partially, the post comprising a ladder formed thereon;

a mount attached to the cylinder;

a positioning element installed on the mount pivotally, the positioning element comprising a dent for engagement with the ladder during an attempt to insert the post into the cylinder and for disengagement from the ladder when the post is extended from the cylinder;

a gear installed on the mount rotationally;

a handle installed on the mount so as to provide pivotal movement in an active direction and in an idle direction opposite to the active direction; and an extending element installed on the handle movably, the extending element comprises a detent for engagement with the gear in the active direction of the pivotal movement of the handle and for disengagement from the gear in the idle direction of the pivotal movement of the handle.

2. The telescopic column according to claim 1 comprising a plate attached to an end of the cylinder.

3. The telescopic column according to claim 1 comprising a plate attached to an end of the post.

4. The telescopic column according to claim 1 wherein the cylinder comprises a semi-cylindrical extension from an end thereof, wherein the mount comprises two flank portions positioned around the semi-cylindrical extension for reinforcing the mount.

5. The telescopic column according to claim 4 comprising a fastener driven in the flank portions of the mount.

6. The telescopic column according to claim 1 wherein the mount comprises two jaws at an end thereof for holding on tight to an end of the cylinder.

7. The telescopic column according to claim 6 comprising a fastener driven in the jaws.

8. The telescopic column according to claim 1 wherein a detent of the positioning element is biased in the direction of the extension of the post from the cylinder.

9. The telescopic column according to claim 4 wherein the positioning element comprises two pivotal portions installed on the flank portions of the mount.

10. The telescopic column according to claim 9 comprising a fastener driven in the pivotal portions of the positioning element and the flank portions of the mount.

11. The telescopic column according to claim 4 wherein the positioning element comprises two prickles on two edges, wherein each of the flank portions of the mount defines a slot for receiving a related one of the prickles so as to limit movement pivotal of the positioning element.

12. The telescopic column according to claim 11 wherein the handle comprises two lateral members each comprising a crow tip for crowing the prickles.

13. The telescopic column according to claim 1 comprising a torque is spring provided between the post and the positioning element.

14. The telescopic column according to claim 1 wherein the detent of the extending element is in the form of a ratchet.

15. The telescopic column according to claim 1 wherein the handle comprises two lateral members each defining a slot, wherein the extending element comprises two fins positioned in the slots movably.

16. The telescopic column according to claim 1 comprising a spring compressed between the handle and the extending element.

17. The telescopic column according to claim 16 wherein the handle comprises a stop for abutting the spring.

18. The telescopic column according to claim 17 wherein the extending element comprises a rod inserted in the spring.

19. The telescopic column according to claim 18 wherein the stop defines an aperture for receiving the rod.

20. The telescopic column according to claim 1 wherein the handle comprising a soft grip positioned at an end thereof.

* * * * *